US005465442A

United States Patent [19]

Merser

[11] Patent Number: 5,465,442

[45] Date of Patent: Nov. 14, 1995

[54] FASTENER SYSTEM FOR USE IN SHOE-LASTING APPLICATIONS

[75] Inventor: F. Gerard Merser, Round Pond, Me.

[73] Assignee: Avery Dennison Corporation, Pasadena, Calif.

[21] Appl. No.: 97,261

[22] Filed: Jul. 23, 1993

[51] Int. Cl.[6] ..... A43D 5/00; A43D 9/00

[52] U.S. Cl. ..... 12/142 LC; 12/113

[58] Field of Search ..... 12/142 LC, 113, 12/145

[56] References Cited

U.S. PATENT DOCUMENTS

| | | | |
|---|---|---|---|
| 223,598 | 1/1880 | McGeorge | 12/113 |
| 760,385 | 5/1904 | Donovan et al. | 12/113 |
| 827,987 | 8/1906 | Miles et al. | 12/113 |
| 1,161,871 | 11/1915 | Lewis | 12/142 LC |
| 1,274,700 | 8/1918 | Fernald | 12/142 LC |
| 3,131,490 | 5/1964 | Rowen | 12/113 |
| 4,094,029 | 6/1978 | Carlile | 12/113 |
| 4,296,515 | 10/1981 | Hauser | 12/142 LC |

OTHER PUBLICATIONS

Avery Dennison Corporation catalog entitled Dennison® SWIFTACH® Systems. This catalog was made available to the public prior to the filing date of the present application.

*Primary Examiner*—Steven N. Meyers
*Attorney, Agent, or Firm*—Kriegsman & Kriegsman

[57] ABSTRACT

A fastener system and for use in tying together a pair of opposing shoelace eyelets of a shoe upper in such a way as to maintain the appropriate spacing between the eyelets while the shoe upper is being lasted. In one embodiment, the fastener system comprises a plastic fastener having a first cross-bar at a first end, a second cross-bar at a second end and a filament portion interconnecting the first cross-bar and the second cross-bar. The fastener system also comprises a plastic retaining tab, the retaining tab being appropriately constructed so that the first cross-bar and the second cross-bar may be inserted therethrough for securement thereto. The retaining tab may be provided with appropriately placed openings to facilitate insertion of the cross-bars through the retaining tab. In use for shoe-lasting applications, the first cross-bar is inserted first through a pair of opposing eyelets of a shoe upper and then through the retaining tab whereas the second cross-bar is inserted directly through the retaining tab. The filament portion is appropriately sized so that, once the cross-bars have been inserted through the retaining tab, the pair of opposing eyelets can be maintained at a desired spacing.

2 Claims, 3 Drawing Sheets

FASTENER SYSTEM FOR USE IN SHOE-LASTING APPLICATIONS

BACKGROUND OF THE INVENTION

The present invention relates generally to a fastener system and more particularly to a and novel fastener system for use in shoe-lasting applications.

Shoe-lasting is a technique commonly employed in the manufacture of footwear for working a shoe upper into its proper form prior to the attachment of a sole thereto. Typically, shoe-lasting comprises placing an unworked shoe upper over a shoe-last, i.e., a mandrel having a shape similar to a shoe tree, and then heating and pulling the shoe upper around the shoe last until the upper conforms generally to the shape of the shoe last.

For shoes of the type that are provided with shoelace eyelets, the above-described technique can pose a problem since the tensioning of the shoe upper around the shoe last can cause the spacing between opposing eyelets on the upper to deviate from what it should be. One approach that has been used to maintain the proper spacing between opposing eyelets on the upper has been to tie together the eyelets with string or the like. Typically, this tying operation is performed with a specifically-designed machine. However, machines of this type have not been made for several years and are, therefore, quite old. In addition, such machines are rather difficult and costly to maintain and use.

Another approach that has been used to maintain the proper spacing between opposing eyelets of a shoe upper during shoe-lasting has been to couple together pairs of opposing eyelets on the upper using plastic fasteners of the type comprising an elongated filament terminating at each end in a cross-bar. To attach the fastener to a shoe upper, one of the cross-bars is inserted through a pair of opposing eyelets on the shoe upper, the other cross-bar not being inserted through either of the eyelets. The cross-bars are appropriately sized so that the fastener cannot easily be pulled through either of the eyelets. This approach, however, has not been found to be entirely satisfactory. This is because, where the eyelets of the upper are relatively large compared to the size of the cross-bars, the magnitude of the force used to pull the upper over the shoe-last is often so great as to cause at least one of the cross-bars to be bent inwardly and then pulled through its respective eyelet.

In commonly-assigned presently pending U.S. patent application Ser. No. 07/968,397, filed Oct. 29, 1992, which is incorporated herein by reference, there is disclosed a plastic fastener which is well-suited for shoe-lasting applications and which solves many of the problems discussed above. In one embodiment, the fastener is a unitary plastic member shaped to include an elongated flexible filament having a cross-bar at one end and a paddle at the opposite end, the paddle being provided with two or more alternative openings through which the cross-bar may be inserted to form a loop. The openings are preferably disposed at different points along the length of the paddle so that different sized loops may be used for different eyelet spacings. To attach the fastener to a pair of eyelets of a shoe upper, the paddle is positioned so that one of its openings is aligned behind one of the eyelets. The filament is then drawn over the upper to the opposite eyelet, and the cross-bar is inserted first through the pair of eyelets and then through the desired opening in the paddle.

Because the paddle and the cross-bar of the aforementioned plastic fastener are mechanically coupled, one problem associated with the fastener is that the paddle opening can be difficult to properly align behind the eyelets of the upper once the cross-bar has been drawn over the upper and inserted through the eyelets. This makes automation of attachment of the fastener to a shoe last more complicated and requires more sophisticated machinery.

Accordingly, it is an object of this invention to provide an improved fastener system for use in maintaining the proper spacing between opposing eyelets on a shoe upper during a shoe-lasting operation.

It is another object of the present invention to provide a method for using the fastener system described above.

It is still another object of the present invention to provide an apparatus for dispensing the component parts of the fastener system described above.

SUMMARY OF THE INVENTION

According to one aspect of the present invention, a new and novel fastener system is disclosed for coupling together opposing eyelets of an upper during shoe-lasting, the fastener system broadly comprising (a) a fastener comprising an elongated filament having a first end and a second end, a first cross-bar at said first end and a second cross-bar at said second end; and (b) a retaining tab, the retaining tab being appropriately constructed so that the first cross-bar and the second cross-bar may be inserted therethrough for securement thereto.

Preferably, the fastener is made of plastic and is capable of being mass produced in a conventional manner as part of a quantity of continuously connected fastener stock. In addition, the retaining tab is preferably also made of plastic and may be formed by extrusion or the like as part of a length of retaining tab stock. Accordingly, using an automated apparatus, an individual fastener can be dispensed from a quantity of fastener stock and attached via its first and second cross-bars to a retaining tab, which may already be or may subsequently be severed from a length of retaining tab stock.

Preferably, the first cross-bar of the fastener is appropriately sized for insertion through a pair of opposing eyelets of a shoe upper. In addition, the filament portion of the fastener is appropriately sized so that, when the first cross-bar is inserted through a pair of opposing eyelets of a shoe upper and the first and second cross-bars are inserted through the retaining tab, the pair of opposing eyelets are tied together in such a way as to maintain the appropriate spacing between the eyelets while the shoe upper is being lasted.

The retaining tab may be provided with openings through which the first and second cross-bars may be inserted.

As can readily be appreciated, because, prior to the insertion of the cross-bars through the retaining tab, the fastener is not physically connected to the retaining tab, one should not experience difficulties in maintaining alignment of the retaining tab with the eyelets of the shoe upper as the first cross-bar is being inserted therethrough.

According to another aspect of the invention, a method of tying together a pair of opposing shoelace eyelets of a shoe upper in such a way as to maintain the appropriate spacing between the eyelets while the shoe upper is being lasted is disclosed, the method broadly comprising the steps of (a) providing a fastener having a first cross-bar at a first end, a second cross-bar at a second end and an appropriately sized filament portion interconnecting the first and second cross-bars, the first cross-bar being sized for insertion through the pair of opposing eyelets of the shoe upper; (b) providing a retaining tab, the retaining tab being appropriately constructed so that the first cross-bar and second cross-bar may be inserted therethrough for securement thereto; (c) inserting the first cross-bar first through the pair of opposing eyelets of the shoe upper and then through the retaining tab; and (d) inserting the second cross-bar through the retaining tab.

According to still another aspect of the invention, an apparatus is disclosed for dispensing the component parts of the fastener system of this invention, the apparatus broadly comprising (a) means for dispensing a retaining tab; and (b) means for dispensing a fastener, the fastener having a first cross-bar at a first end, a second cross-bar at a second end, and a filament portion interconnecting the first cross-bar and the second cross-bar, the first and second cross-bars being insertable through the retaining tab.

As can readily be appreciated, the aforementioned apparatus can be used to attach the above-described fastener system to a shoe upper for shoe-lasting applications by properly aligning a shoe upper relative to the apparatus so that one of the cross-bars of a fastener is inserted through a pair of opposing eyelets of the shoe upper prior to its insertion through the retaining tab.

Additional objects, features, advantages and aspects of the present invention will be set forth in part in the description which follows, and in part will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts.

DETAILED DESCRIPTION OF PREFERRED EMBODIMENTS

Figure 1:
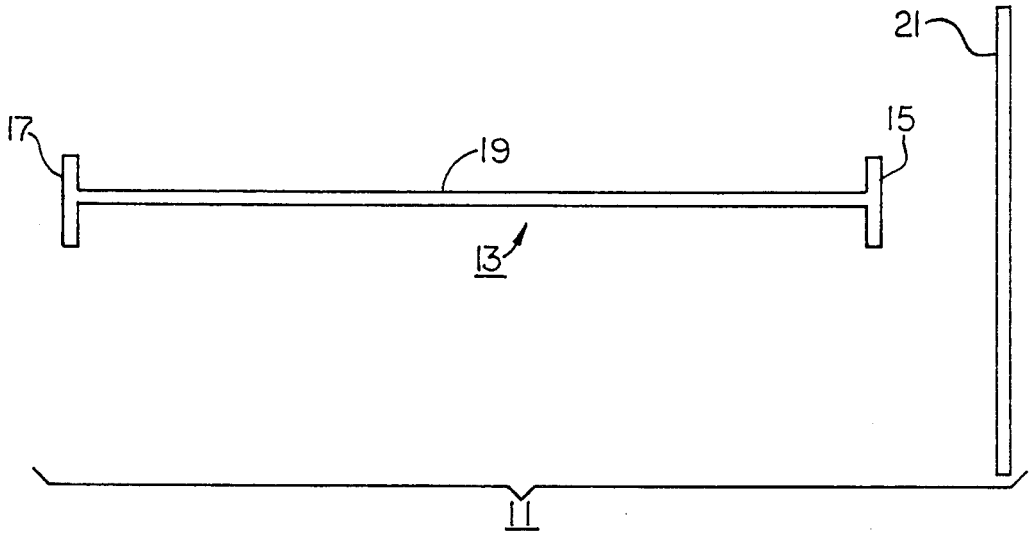
FIG. 1 is an enlarged top view of one embodiment of a fastener system constructed according to the teachings of the present invention for tying together a pair of opposing shoelace eyelets of a shoe upper in such a way as to maintain the appropriate spacing between the eyelets while the shoe upper is being lasted.
Figure 2:
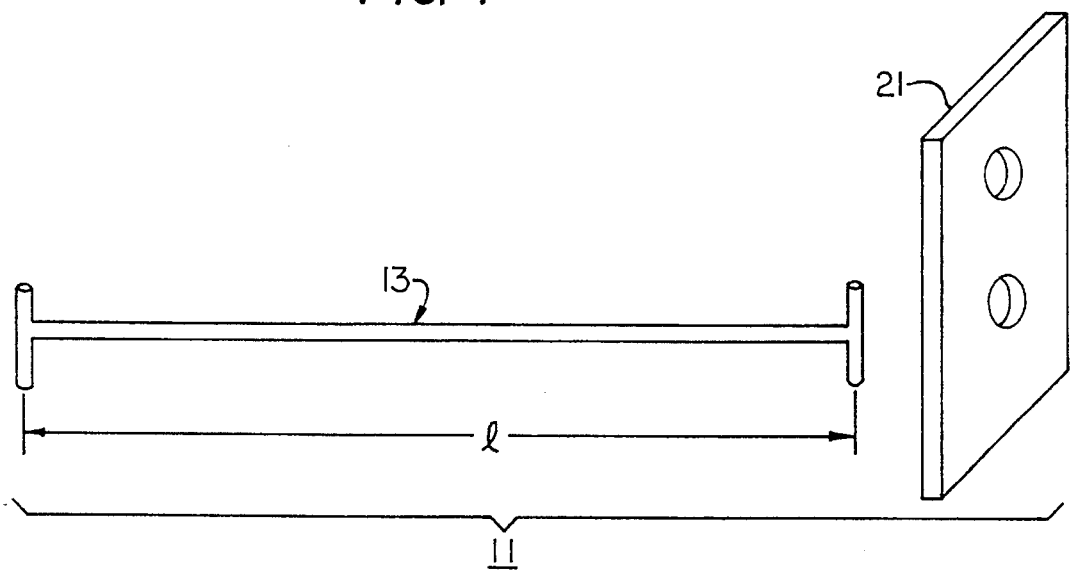
FIG. 2 is a perspective view of the fastener system shown in FIG. 1.

Referring now to FIGS. 1 and 2, there are shown enlarged top and perspective views, respectively of one embodiment of a fastener system constructed according to the teachings of the present invention, the fastener system being represented generally by reference numeral 11.

Fastener system 11 includes a fastener 13. Fastener 13 is an elongated unitary plastic member shaped to include a first cross-bar 15, a second cross-bar 17, and a filament portion 19 interconnecting cross-bars 15 and 17. For reasons to be discussed below, at least cross-bar 15 and filament portion 19 are appropriately sized in cross-sectional diameter so as to be insertable through a pair of opposing eyelets of a shoe upper.

Fastener 13 may be molded as part of a quantity of continuously connected fastener stock.

Fastener system 11 also includes a retaining tab 21. Retaining tab 21 includes a pair of openings 23 and 25, which are appropriately dimensioned so that cross-bars 15 and 17, respectively, may be inserted therethrough in such a way as to secure fastener 13 to tab 21. Retaining tab 21 is preferably made from extruded plastic and may be formed as part of a length of retaining tab stock (not shown). Such retaining tab stock could be provided with perforations or the like connecting adjacent retainer tabs to facilitate severing individual retaining tabs from the remainder of the stock.

Figure 3:
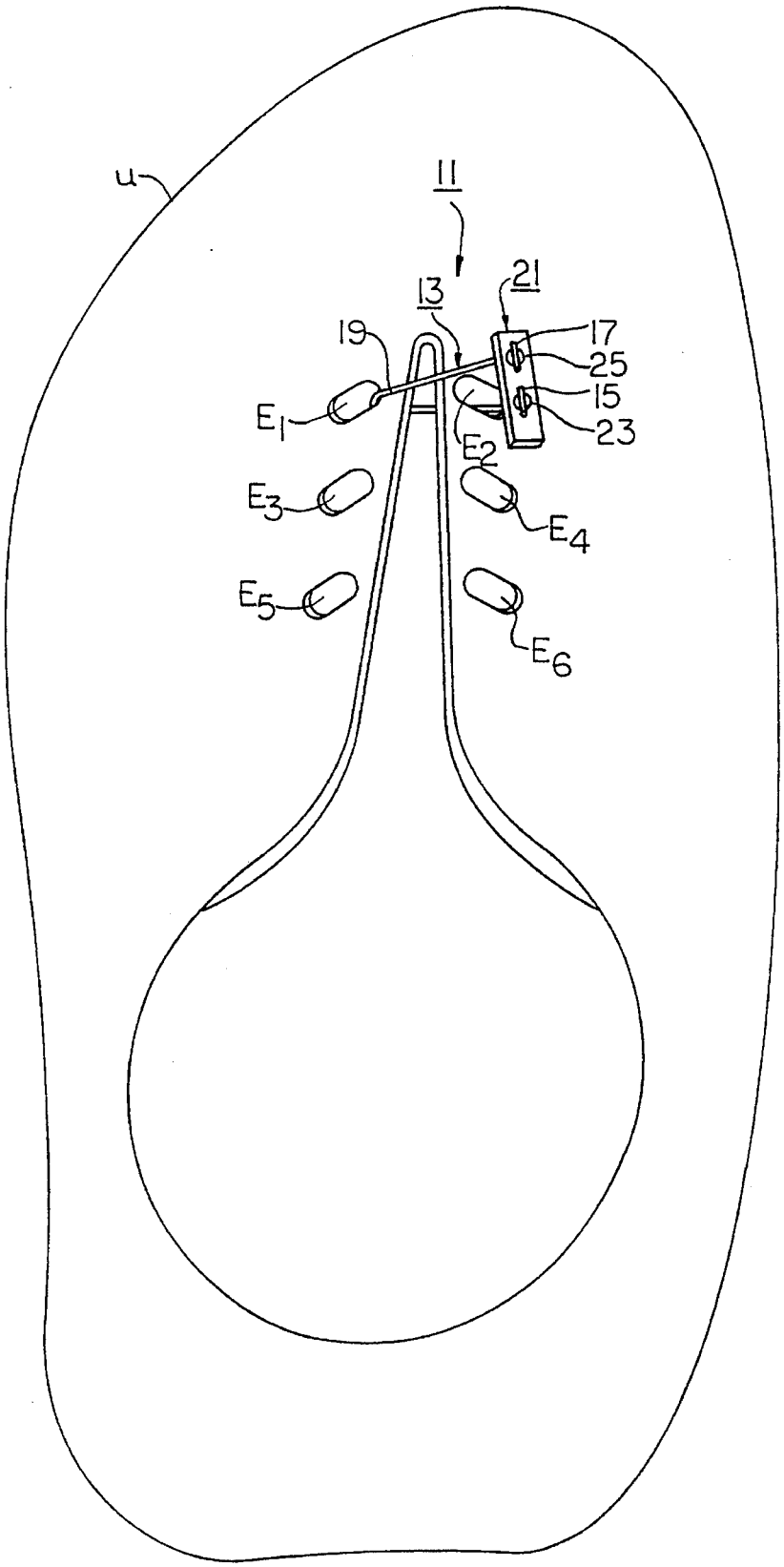
FIG. 3 is a perspective view showing how the fastener system shown in FIG. 1 may be used to tie together a pair of opposing shoelace eyelets of a shoe upper in such a way as to maintain the appropriate spacing between the eyelets while the shoe upper is being lasted.
Figure 5:
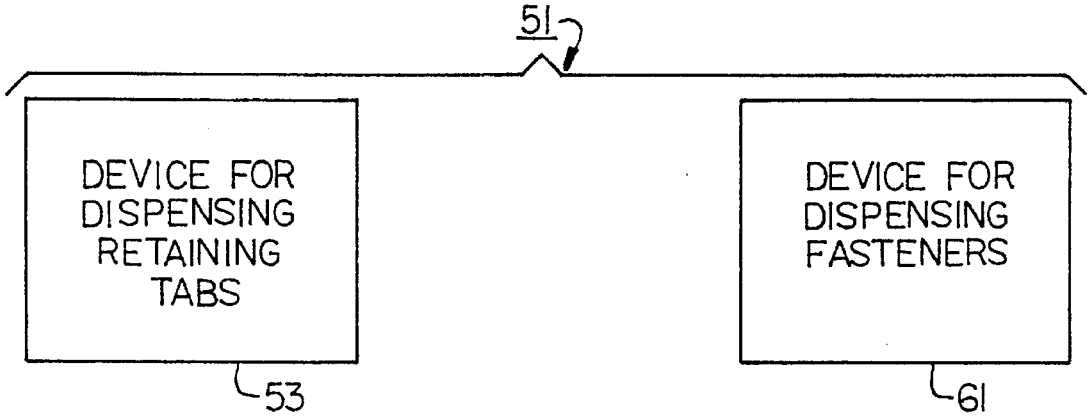
FIG. 5 is a block diagram of one embodiment of an apparatus for dispensing the component parts of the fastener system shown in FIG. 1.
Figure 4:
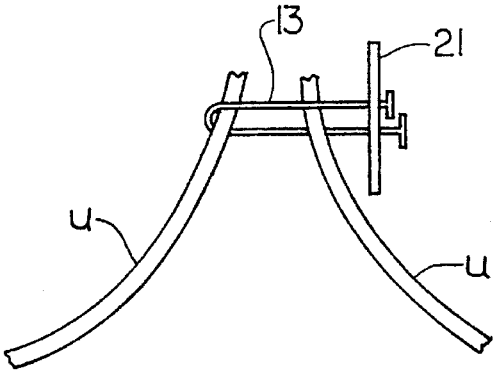
FIG. 4 is a fragmentary front view of the fastener system and shoe upper shown in FIG. 3.

Referring now to FIGS. 3 and 4, the manner in which fastener system 11 may be used to tie together a pair of opposing shoelace eyelets $E_1$ and $E_2$ of a shoe upper U in such a way as to maintain the proper spacing therebetween is illustrated. As can be seen, to attach fastener system 11 to upper U as shown, one must (1) insert cross-bar 15 first through eyelets $E_1$ and $E_2$ of upper U and then through opening 23 of tab 21; and (2) insert cross-bar 17 directly through opening 25 of tab 21.

As can readily be appreciated, for best results in maintaining a desired spacing between opposing eyelets of a shoe upper, filament portion 19 of fastener 13 preferably has a length l (see FIG. 2) which approximates slightly more than the desired spacing between the opposing eyelets. Consequently, when using fastener system 11 to tie together multiple pairs of eyelets of a shoe upper (such as eyelets $E_1$ and $E_2$, $E_3$ and $E_4$ and $E_5$ and $E_6$ in the upper shown in FIG. 3) it will often be necessary to use fasteners 13 of different filament lengths.

Insertion of cross-bars 15 and 17 of fastener 13 through openings 23 and 25, respectively, may be accomplished manually, or with the aid of a fastener dispensing gun or machine. As can readily be appreciated, the use of a fastener dispenser gun or fastener dispensing machine may be highly desirable if individual fasteners 13 need to be dispensed from fastener stock in addition to being manipulated in the manner described above.

It should be understood that retaining tab 21 need not be provided with pre-existing openings through which cross-bars 15 and 17 may be inserted so long as retaining tab 21 is made of a material through which cross-bars 15 and 17 may be inserted, either by applying force thereto and/or with the aid of a tagging gun needle or otherwise. One advantage to not having pre-existing openings in retaining tab 21 is that precise alignment of cross-bars 15 and 17 with said openings is not required.

Also, the fasteners need not be the straight type as shown in FIGS. 1 and 2 but could be curved or looped or U shaped.

Referring now to FIG. 4, there is shown a block diagram of a fastener apparatus constructed according to the teachings of the present invention for dispensing the component parts of the fastener system of this invention, the fastener apparatus being represented generally by reference numeral 51. Fastener apparatus 51 includes a device 53 for dispensing retaining tabs. Device 53 may either be constructed to dispense a length of tab stock wherein the individual retaining tabs must then be severed from one another by the user or be constructed to dispense individual tabs (i.e. tabs already severed from the tab stock).

Apparatus 51 also includes a device 61 for dispensing individual fasteners 13. Device 61 preferably includes a pair of feed mechanisms, each arranged to eject one of the cross-bars of a fastener 13 being dispensed. The two feed mechanisms may be arranged to operate simultaneously using either separate trigger devices or one common trigger device or may be arranged to operate sequentially.

As can readily be appreciated, the aforementioned fastener apparatus can be used to attach the above-described fastener system to a shoe upper for shoe-lasting applications by properly aligning a shoe upper relative to the fastener apparatus so that one of the cross-bars of a loop fastener is inserted through a pair of opposing eyelets of the shoe upper prior to its insertion through the retaining tab stock.

It should be understood that fastener system 11 and fastener apparatus 51 can be used for purposes other than tying together a pair of opposing eyelets of a shoe upper for maintaining a desired spacing therebetween while the shoe upper is being lasted.

After shoe-lasting has been completed, fastener system 11 may be removed from shoe upper U, for example, by severing filament portion 19, with a knife or the like.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. A method of tying together a pair of opposing shoelace eyelets of a shoe upper in such a way as to maintain the appropriate spacing between the eyelets while the shoe upper is being lasted, said method comprising the steps of:

(a) providing a fastener, said fastener having a first cross-bar at a first end, a second cross-bar at a second end and an appropriately sized filament portion interconnecting said first and said second cross-bars, said first cross-bar being sized for insertion through the pair of opposing eyelets of the shoe upper;

(b) providing a retaining tab, said retaining tab being appropriately constructed so that said first cross-bar and said second cross-bar are capable of being inserted therethrough for securement thereto;

(c) inserting said first cross-bar first through the pair of opposing eyelets of the shoe upper and then through said retaining tab; and (d) then, inserting said second cross-bar through said retaining tab.

2. The method as claimed in claim 1 wherein said retaining tab has a first opening through which said first cross-bar is capable of being inserted and a second opening through which said second cross-bar is capable of being inserted.

* * * * *